United States Patent [19]

Secon

[11] Patent Number: 4,473,254

[45] Date of Patent: Sep. 25, 1984

[54] LAWN CHAIR

[75] Inventor: Edward Secon, Trumbull, Conn.

[73] Assignee: The Sherwood Corporation, Spring City, Tenn.

[21] Appl. No.: 267,370

[22] Filed: May 26, 1981

[51] Int. Cl.[3] ..... A47C 13/00

[52] U.S. Cl. ..... 297/111; 297/118; 297/432; 297/440; 5/18 R

[58] Field of Search ..... 297/108, 105, 111, 118, 297/432, 440, 456; 211/181, 182; 5/465, 18 R

[56] References Cited

U.S. PATENT DOCUMENTS

| | | | |
|---|---|---|---|
| 1,413,595 | 4/1922 | Kreuzkamp | 5/18 R |
| 1,559,064 | 10/1925 | Bitney | 211/181 |
| 2,850,172 | 9/1958 | Beckner | 211/181 |
| 2,930,486 | 3/1960 | Hoover | 211/181 X |
| 3,385,631 | 5/1968 | Gertler | 297/111 |
| 3,555,581 | 1/1971 | Friant | 5/465 |
| 3,742,526 | 7/1973 | Lillard | 297/118 |
| 3,751,739 | 8/1973 | Assmann | 297/118 |
| 3,875,711 | 4/1975 | Palmer | 211/182 |
| 3,902,759 | 9/1975 | Monteforte | 297/456 |
| 4,148,521 | 4/1979 | Van Hook | 297/456 |

*Primary Examiner*—Francis K. Zugel
*Attorney, Agent, or Firm*—Alan Ruderman

[57] ABSTRACT

A convertible lawn chair having a modular frame construction with each module formed from wire rod, rods on adjacent modules being interconnected by clamping members having a pair of rod receiving channels. The chair has a pair of nested U-shaped extendable members readily extendible from a retracted disposition beneath a seat support module. A cushion pad having a number of hinged folds is foldable into a cushion seat and back and can be unfolded into the chaise lounge position onto the extendible members. The hinge folds are provided by a covering over a number of separate cushion sections, the various sections providing substantially continuous surfaces in both the chair and lounge configurations.

7 Claims, 8 Drawing Figures

LAWN CHAIR

BACKGROUND OF THE INVENTION

This invention relates to lawn furniture and more particularly to a modular frame cushion chair of this type readily convertible into a chaise lounge or sleeper by extending a number of telescopic frame members and unfolding sections of the cushion.

Although furniture convertible from a sofa or chair to a bed are well known they generally require complex articulating mechanisms and thus suffer from the disadvantage of being unduly expensive. One prior art chair convertible into a bed which does not have foldable structural members is illustrated in U.S. Pat. No. 3,385,631 and is a wood structure having intricate wood extension members which retract into the bottom of the front of the chair. This chair has three independent cushions, each of a different depth, two of which comprise the chair seat and the other of which comprises the chair back and when extended into a bed the cushions must individually be placed upon the extension members to form the mattress surface. Moreover, because of the structural construction of such a chair-bed the manufacturing costs are unduly prohibitive for adoption to lawn furniture. Other known convertible furniture which have foldable sections rather than articulating mechanisms are illustrated in U.S. Pat. No. 3,890,658; and co-pending U.S. patent applications of Tiffany Ser. Nos. 7,388 and 7,389 filed Jan. 29, 1979. However, this prior art furniture cannot be used for lawn furniture because the seat and back are foldable onto the floor. Lawn furniture must be durable, weather resistant, functionally self-contained and relatively inexpensive. Moreover, they should also be readily packagable in low profile containers to reduce transportation costs, and should be stowable during the cold seasons. To this end the lawn furniture should be capable of being readily disassembled and assembled without special skills or tools.

SUMMARY OF THE INVENTION

The present invention fulfills these requirements for lawn furniture by providing a lawn chair having an inexpensive durable construction readily convertible from a chair to a chaise lounge. The chair has a wire rod frame construction including a cushion pad seat and back, conversion being achieved by extendible U-shaped wire rod frame members telescopically stored beneath the seat of the chair and by unfolding portions of the seat and back at fabric hinges for superposition upon the extended members. Preferrably the seat frame is also a U-shaped member similar to the extendible members so that in the chair condition the three members are nested beneath the surface of the seat without disturbing the aesthetics of the furniture. Moreover, the frame of the chair is a modular construction, the wire rods being readily connected together by small channeled clamping members and can be readily disassembled for storage and reassembled for use. The modular construction is applicable to the lawn furniture even without the convertible feature and thus only the addition of the extendible members may be needed to convert a lawn chair with this construction to a chaise lounge. The cushion pad seat and back are fabric covered spongy material and comprise a number of hinged sections so that the pad provides a substantially continous surface in both the chair and chaise lounge conditions. A separate wedge shaped back support provides a properly inclined chair back for comfort and may be flipped to provide a head rest or pillow for the chaise lounge.

Consequently, it is a primary object of the present invention to provide lawn furniture of a modular construction readily convertible from a chair configuration to a chaise lounge configuration.

It is another object of the present invention to provide a lawn chair having a wire rod construction and a cushion pad providing a seat and back, the chair being convertible into a chaise lounge by extending telescopic members nested beneath the seat and by unfolding the cushion pad along a number of hinged contiguous edges.

It is a further object of the present invention to provide lawn furniture having a modular wire rod frame construction, the modules being readily assembled by channeled clamping members interconnecting adjacent modular elements together.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
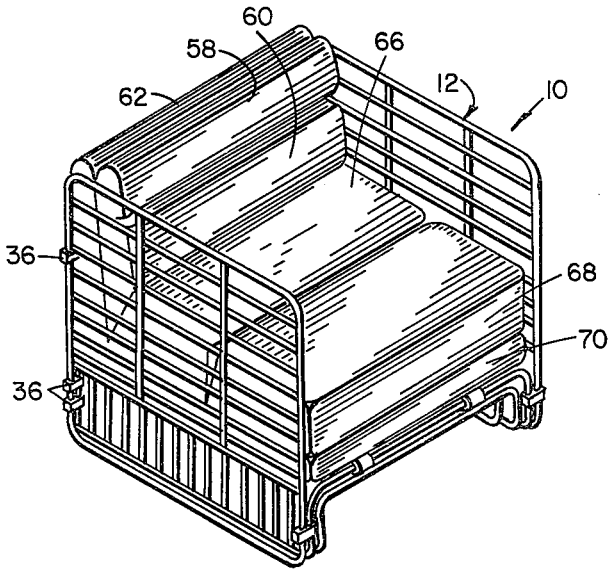
FIG. 1 is a front perspective view of a lawn chair constructed in accordance with the principles of the present invention.
Figure 2:
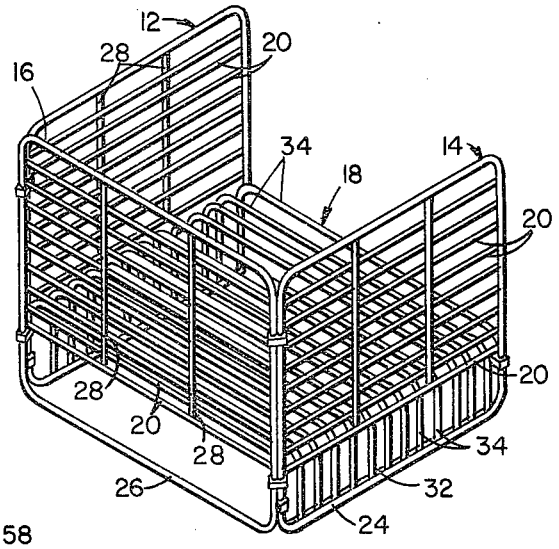
FIG. 2 is a rear perspective view of the chair illustrated in FIG. 1 with the cushion pad removed.

Referring now to the drawings and in particular to FIGS. 1 and 2, a lawn chair 10 according to the present invention comprises a frame having a wire rod construction, the wire rod being conventional wrought iron type material coated or covered by a plastisized material such as vinyl to provide durability for withstanding the outdoor weather. The frame has a modular construction and includes a pair of spaced upstanding side members 12, 14 interconnected at the rear to an upstanding back member 16 and at opposed vertically medial sections to an inverted U-shaped member having a substantially horizontally disposed seat support member 18. Each of the modular members 12,14,16 has a peripheral border formed by preferably one rod shaped into a substantially rectangular configuration and includes a number of parallel spanning rods 20 fixed to and interconnecting opposed edges of the border to provide a rigid structure. In the embodiment disclosed in FIGS. 1 through 6 these rods 20 are horizontally disposed, and for aesthetic reasons the lowermost of the rods 20 may be spaced from the bottom edges 22, 24, 26 of the respective sides and back. To add further support and appeal, a number of parallel vertical rods 28 may be fixedly secured to the lowermost rod 20 at the top of each module and to the rods 20 at the point of intersection therewith.

The seat support module 18 is constructed in a manner similar to the side and back modules, but additionally, the wire rod forming its border is bent downwardly adjacent the plane of each side so that those border rods 30, 32 spaced apart at the sides rest on the ground surface adjacent the respective bottom edge 22, 24 of the adjacent side 12, 14. Likewise, the spanning rods 34 of the seat support module 18 are bent from the plane of the horizontal seating support surface into the vertical plane to form an inverted U and are fixed to the rods 30 and 32 at the opposed sides.

Figure 7:
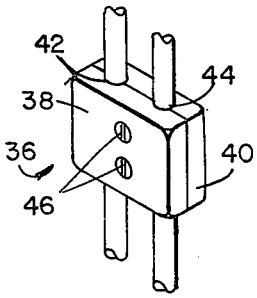
FIG. 7 is an enlarged perspective view of a portion of the chair illustrating one form of the clamping members and the manner of connecting adjacent modular frame members.

To readily assemble and disassemble the modular members 12, 14, 16 and 18 together into a structurally rigid frame, the invention, as best illustrated in FIG. 7, provides rod receiving channel clamping members 36. The clamping members are two part complimentary blocks 38, 40 having two rod receiving channels 42, 44, half of each channel being formed as a groove in each block. Fasteners such as one or two screws 46 secure the blocks together with the rods secured within the channels. Thus, the clamps 36 are disposed at a number of locations along the adjacent edges of the back member 16 and the side members 12 and 14 to fasten the sides to the back, and at a number of locations along the vertically depending portion of the seat member 18 adjacent the sides and secure the seat member to the sides.

Figure 8:
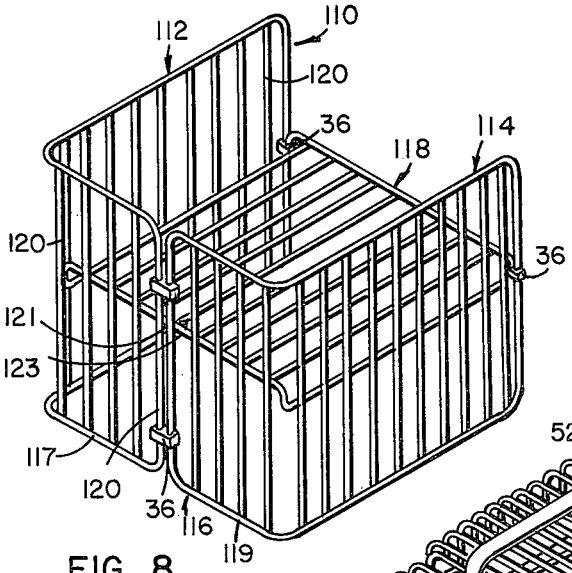
FIG. 8 is a view similar to FIG. 2, but of a modified chair construction.

In the embodiment illustrated in FIG. 8 a lawn chair 110 is illustrated in which the back comprises members formed integral with the side members 112, 114, half 117 of the back 116 comprises a portion bent substantially 90 degrees from the main plane of side member 112 and the other half 119 of the back comprises a portion bent 90 degrees from the main plane of the side member 114. The spanning rods 120 of this embodiment preferably are vertically extending and those rods of each half 117, 119 most remote from the plane of the sides are clamped together at two locations with clamping members 36. The seat support member 118 includes a border rod bent at least at the front of the seat support into a vertical disposition and clamping members 36 secure the front of the seat 118 to the side members 112, 114. At the rear, the seat member 118 may rest on a pair of ledges 121, 123 formed of rod and respectively fixed to the adjacent rods of the back halves of the side members 112 and 114 that are clamped together. Thus, as in the first embodiment, the chair of this embodiment is in modular form and can be readily assembled and disassembled.

Figure 3:
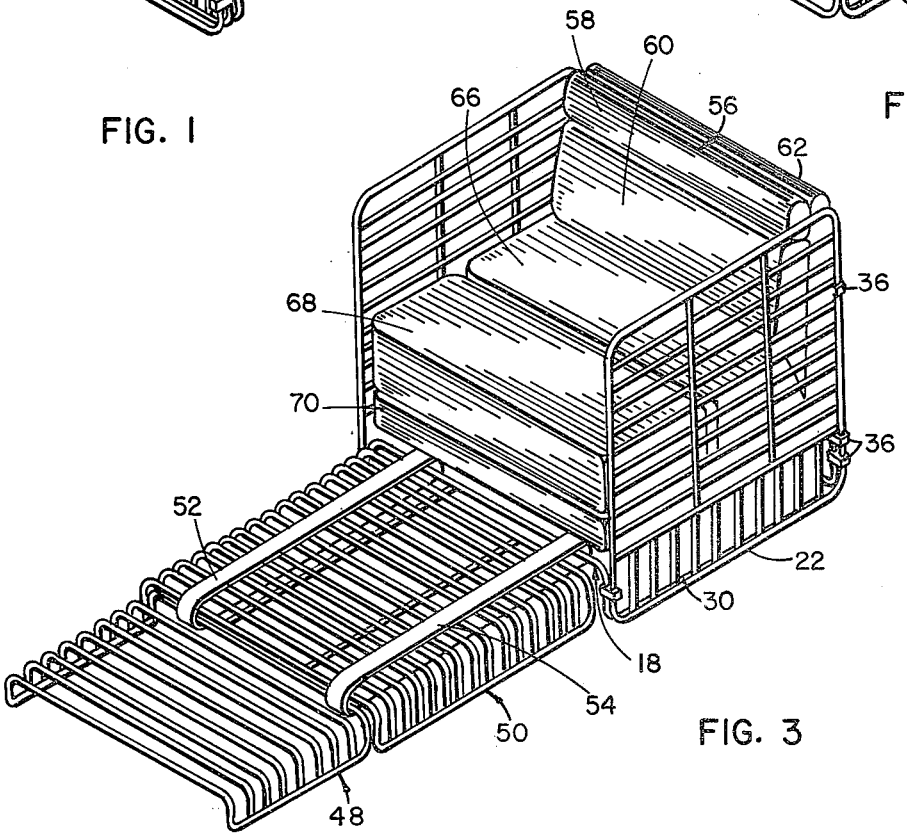
FIG. 3 is a view similar to that of FIG. 1, but with the extension frames extended into the chaise lounge position.
Figure 4:
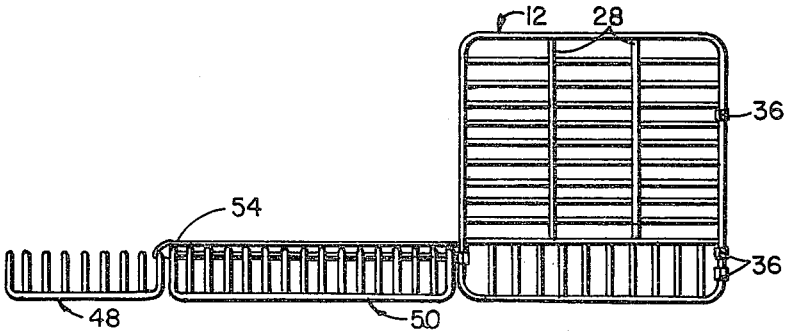
FIG. 4 is a side elevational view the lounge position illustrated in FIG. 3, but with the cushion pad removed.

Referring to FIGS. 1 and 3, the lawn chair illustrated can be readily converted into a chaise lounge and to this end a pair of inverted U-shaped extension members 48, 50 are nested beneath the seat support member 18. The member 50 is slightly narrower in width than the spacing between the sides 12 and 14 and smaller in vertical depth or height than the space between the seat support member 18 and the ground so that the member 18 can be positioned beneath the seat when stored during use as a chair. The length of the member 50 is such that it does not protrude beyond the front of the seat support when so stored. The member 48 likewise is slightly smaller than the member 50 and can be disposed within and beneath the member 50 when stored and not protrude beyond the front thereof. Each member 48, 50 is similar in design configuration and construction to the seat support, having a border comprising a rod bent into the appropriate configuration and braced by a plurality of inverted U-shaped rods between the front and rear border.

To prevent the members 48, 50 from separating from each other and from the front of the chair a pair of webings 52, 54 preferably of a plastic material are trained about the front rod of the seat member 18 and extend over and under the horizontally disposed surface of the member 50 and are trained about the rear rod of the member 48. The ends of the web are fastened together so that each forms an endless belt. Thus, when the extension member 48 is extended from the nested position beneath the extension member 50, the member 50 is also extended until the belt is fully extended, this corresponding to the fully extended position of the members 48 and 50.

Disposed on the seat support is a cushion seat and back pad generally indicated at 56. The seat and back pad comprise a number of separate independent sponge-like material sections such as polyurethane foam mounted within a fabric covering which may be nylon or other similar material having durability for use outdoors. The various sections are folded over upon each other at fabric hinges to provide the seat and back in the chair condition and unfold to lay upon the extension member 48 and 50 when they are extended.

Figure 6:
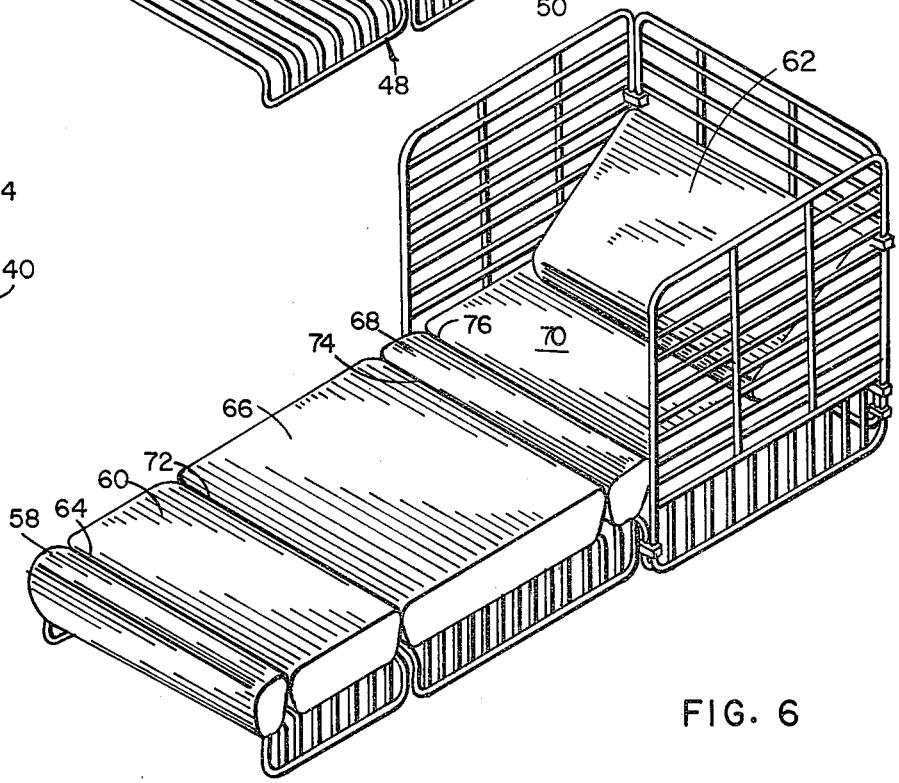
FIG. 6 is a view similar to FIG. 3 with the cushion pad unfolded to the chaise lounge condition.

The seat and back pad 56 comprise a back having an upper section 58 and a lower section 60 which both abut a separate wedge shaped back rest 62 in the chair condition. The section 60 has a surface that normally substantially abuts the adjacent surface of the section 58, the covering being fitted about the surfaces to maintain them separate except at an edge 64, so although sections 58 and 60 are separate, they are connected together at the edge 64. Thus, except at the edge 64, the sections 58 and 60 can otherwise move independently. Similarly, the seat comprises normally upper sections 66 and 68 and a normally lower section 70, the section 66 being connnected to the back section 60 by the fabric at an edge 72 and to the section 68 by the fabric at an edge 74, the section 68 being further connected by the fabric to the section 70 by an edge 76. With reference to FIG. 6, the length of the various sections can be seen to be such that sections 58 and 60 together not only are substantially equal to and preferrably slightly longer than the top of the back 16 in the chair condition when disposed on the rear of section 70, but also are substantially equal to the front to rear dimension of the member 48. Similarly, the sections 66 and 68 are substantially equal to the front to rear dimension of the member 50.

Figure 5:
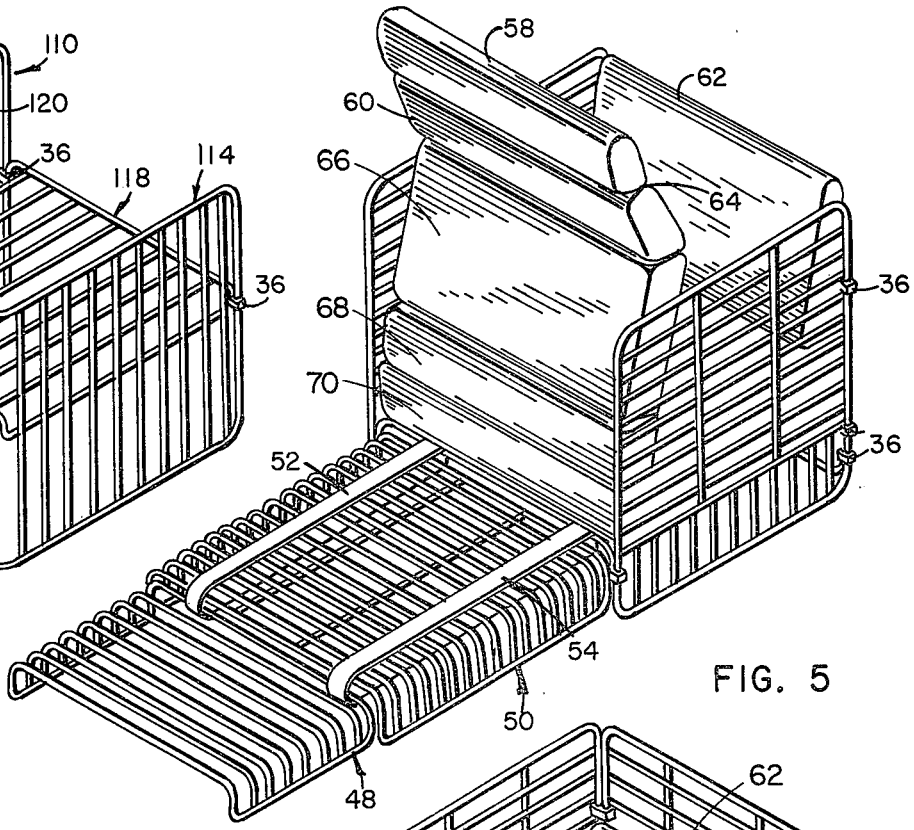
FIG. 5 is a view similar to FIG. 3, but with the cushion pad in a partially unfolded condition.

With reference to FIGS. 3, 5 and 6 it can be seen that the chair is readily converted to a chaise lounge by extending the members 48 and 50 and unfolding the cushion at the hinged edges. The adjacent surfaces of the various pad sections have diverging configurations forming wedge shaped spacings between the sections so that in the chair condition the surfaces are substantially continuous, when unfolded, however, the surfaces separate except at the hinged edges. The cushion unfolds at edges 72 and 76 to extend the back and seat portions. The edges 64 and 74 have the hinged construction so that the adjacent sections can articulate relatively to each other to provide a smooth seat and leg support in spite of the slightly different elevations of the members 48, 50 and the seat support 16. The hinged edge 64, moreover, allows the back to be angularly disposed against the front surface of the wedge 62 in the chair condition. Upon fully unfolding the cushion pad, the back rest wedge 62 may be repositioned onto the surface of the section 70 to form a pillow type head rest, the wedge being rotated or flipped for comfort.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A lawn chair having a modular frame construction comprising, a number of members forming a seat support, back and opposed sides, each of said members comprising a structure defined by a first elongated rod formed in a manner to define the periphery of the member, a plurality of spaced second rods fixed to and extending between opposed locations on the periphery of each member to provide a grid-like structure. Clamping means for fastening the members into a chair form, said clamping means comprising a pair of rigid blocks having abutting faces including at least a pair of substantially spaced grooves formed in each of said faces, each groove of one block being complimentary to a corresponding groove in the other block to define a channel for receiving adjacent portions of said first rod of adjacent members, means for securing said blocks together about said adjacent portions of said first rods of said members, a continuous cushion pad on said seat support for normally forming a cushioned seating surface and a cushioned back, said seat support including a bottom surface spaced above a chair support surface, said chair including at least a pair of substantially inverted U-shaped extendible members normally nested one within the other beneath said seat support and extendible relatively thereto along extremities forming the U-shape, said U-shape members forming an open channel extending toward the back substantially parallel to the sides and means for permitting said extendible members to be extracted from beneath the seat support while preventing the extendible members from being extended beyond the full front to rear extent, whereby said chair is convertible into a chaise lounge.

2. A lawn chair as recited in claim 1, wherein said cushion pad comprises a plurality of cushion sections arranged in series with adjacent sections hingedly joined together at one contiguous edge, a first of said sections being disposed upon said seat support, a second of said sections having an edge adjoining and contiguous with said first section and normally being folded upon said first section along the adjoining contiguous edge, a third of said sections having an edge adjoining and contiguous with said second section remote from said first section, said edge being one edge of adjacent surfaces of the second and third sections, the remainder of said adjacent surfaces diverging from each other so that the entire third section normally is folded into an upstanding disposition relatively to said second section and upon the first section to form said cushion back, said second and third sections being unfolded onto said extendible members when said members are fully extended.

3. A lawn chair as recited in claim 2, wherein said second section comprises a pair of sections hingedly joined together at a contiguous edge forming one edge of adjacent surfaces of said pair of sections, the remainder of said adjacent surfaces diverging from each other.

4. A lawn chair as recited in claim 3, wherein said third section comprises a pair of sections hingedly joined together at a contiguous edge forming one edge of adjacent surfaces of said pair of sections, the remainder of said adjacent surfaces diverging from each other.

5. A lawn chair convertible into a chaise lounge comprising, a frame including a seat support, back and opposed sides, said seat support including a bottom surface spaced above a chair support surface, said chair including at least a pair of substantially inverted U-shaped extendible members normally nested one within the other beneath said seat support and extendible relatively thereto along extemities forming the U-shape, said U-shaped members forming an open channel extending toward the back substantially parallel to the sides, means for permitting said extendible members to be extracted from beneath the seat support while preventing the extendible members from being extended beyond their full front to rear extent, said chair including a cushion pad positioned on said seat support for normally forming a cushioned seating surface and a cushioned back, said cushion pad comprising a plurality of cushion sections arranged in series with adjacent sections hingedly joined together at one contiguous edge, a first of said sections being disposed upon said seat support, a second of said sections having an edge adjoining and contiguous with said first section and normally being folded upon said first section along the adjoining contiguous edge, a third of said sections having an edge adjoining and contiguous with said second section remote from said first section, said edge being one edge of adjacent surfaces of the second and third sections, the remainder of said adjacent surfaces diverging from each other so that the entire third section normally is folded into an upstanding disposition relatively to said second section to form said cushion back, said second and third sections being unfolded onto said extendible members when said members are fully extended.

6. A lawn chair as recited in claim 5, wherein said second section comprises a pair of sections hingedly joined together at a contiguous edge forming one edge of adjacent surfaces of said pair of sections, the remainder of said adjacent surfaces diverging from each other.

7. A lawn chair as recited in claim 6, wherein said third section comprises a pair of sections hingedly joined together at a contiguous edge forming one edge of adjacent surfaces of said pair of sections, the remainder of said adjacent surfaces diverging from each other.

* * * * *